US008413266B2

(12) United States Patent
Solotoff

(10) Patent No.: US 8,413,266 B2
(45) Date of Patent: Apr. 9, 2013

(54) MANUFACTURING METHOD FOR PANT LEG BOTTOMS

(76) Inventor: Brandon Solotoff, Nutley, NJ (US)

( * ) Notice: Subject to any disclaimer, the term of this patent is extended or adjusted under 35 U.S.C. 154(b) by 241 days.

(21) Appl. No.: 12/802,225

(22) Filed: Jun. 2, 2010

(65) Prior Publication Data

US 2011/0265249 A1 Nov. 3, 2011

Related U.S. Application Data

(60) Provisional application No. 61/329,094, filed on Apr. 29, 2010.

(51) Int. Cl.
*A41D 1/06* (2006.01)

(52) U.S. Cl. ..... 2/232; 2/231; 2/227

(58) Field of Classification Search ..... 2/227, 232, 2/231, 242, 60, 269, 244, 132, 79, 69, 243.1, 2/911, 245; 36/70 R, 70 A; D2/742, 744, D2/748

See application file for complete search history.

(56) References Cited

U.S. PATENT DOCUMENTS 3,787,892 A * 1/1974 Quinn ..... 2/466
4,710,978 A * 12/1987 Pankopf ..... 2/2.16
D461,944 S * 8/2002 Williams, Jr. ..... D2/858
D598,178 S * 8/2009 Cutlip et al. ..... D2/742

* cited by examiner

*Primary Examiner* — Khoa Huynh
*Assistant Examiner* — Khaled Annis
(74) *Attorney, Agent, or Firm* — Thomas A. O'Rourke; Bodner & O'Rourke, LLP

(57) ABSTRACT

A method for creating a series of size-proportioned trouser bottoms comprises each of the slack bottoms being approximated as a cylindrical surface transitioning into a circular conical surface. The back lower portion of the circular conical surface is trimmed along a cutting plane to produce a parabolic-shaped rear edge, to provide rear clearance above a shoe heel. The front lower portion of the circular conical surface is trimmed along second cutting plane producing a unique parabolic-shape front edge for clearance above a shoe throat. Trimming may be by a CNC fabric cutting machine, using the descriptive geometric definition of the circular conical surface, $(x/\alpha)^2+(y/\beta)^2(z/\gamma)^2=0$, and using planar cuts for the parabolic edge trim defined by the equation, $Ax+\Gamma z+\Delta=0$. The defined surface may be unwrapped and supplied to the CNC machine as a flat pattern.

11 Claims, 13 Drawing Sheets

MANUFACTURING METHOD FOR PANT LEG BOTTOMS

CROSS REFERENCES TO

This application claims priority on U.S. Provisional Application Ser. No. 61/329,094 filed on Apr. 29, 2010, having the title, "Concave Pants," the disclosures of which are incorporated herein by reference.

FIELD OF THE INVENTION

The present invention relates to improvements in the formation of garments, and more particularly to a method or forming slack legs which are capable of providing better wear characteristics of the slack bottoms and enhance overall longevity of the garment.

BACKGROUND OF THE INVENTION

The manufacture of textiles dates back many thousands of years, where a textile is generally understood to be any material made of interlacing fibers, and more specifically comprises fabric material made through weaving, knitting, crocheting, or bonding. The manufacture of textiles into a cloth—a finished piece of fabric that can be used for a purpose—has evolved significantly over time, and is reflected in the prior art, particularly with respect to garments intended to serve as apparel.

The production of apparel had been performed manually in clothing companies, until an Englishman, Thomas Saint, developed a machine to stitch together leather or canvas materials, for which he was granted a patent. Improvements were made, and eventually, in 1846, Elias Howe was granted the first American patent for a sewing machine—U.S. Pat. No. 4,750. Although the name Singer has for a long time been synonymous with sewing machines in the U.S., Isaac Merritt Singer actually received U.S. Pat. No. 8,294 in 1851 for improvement made to the then existing prior art. After a subsequent suit between Howe and Singer was decided in Howe's favor Law suit, Singer was granted licenses to manufacture sewing machines. Methods and apparatus further directed at producing apparel and distinct portions thereof have since proliferated. Perhaps one of the most famous articles of manufacture in the form of apparel being U.S. Pat. No. 139,121 to Jacob Davis and Levi Straus for "Fastening Pocket-Openings," which led to Levi blue jeans.

Another example is shown by U.S. Pat. No. 4,069,514 to Palmieri for "Beltless Slacks." Palmieri offers a novel means of support which provides the slacks with "a distinctive and attractive appearance." The means of support did not rely on belts or elastic bands, but rather on an inner flap that is tapered from a long vertical side to a short vertical side. Another similar invention is shown by U.S. Pat. No. 4,139,913 to Garin for "Extensible Maternity Slacks," wherein a front flap is adapted to be joined at the edge of a rear flap using a button-hole co-operating with a plurality of buttons.

Improvements more particularly directed to the bottoms of the slacks, which are also referred to as pants, or more commonly in the United Kingdom as trousers, and in many Spanish speaking neighborhoods and countries as Pantaloons, include U.S. Pat. No. 4,843,654 to March, for "Riding Pants." The March cold-weather riding pants include a "biaxially stretchable elastic fabric along the outside or outer seam of each leg" and additionally, for each lower leg pant or end, "an adjustable stirrup adapted to pass under the arch of the riding boot to maintain the leg pant in proper relation to the riding boot." The March pants provide the necessary warmth, but in addition, satisfy the form-fitting requirements while maintaining freedom of movement, and also serve in "securing the lower pants leg in proper relationship to the riding boot." The use of stirrups in maintaining proper form and/or location of the pant bottom has been used in combination in other inventions, including U.S. Pat. No. 5,134,726 to Ross for "Sport Pants with Protective Pads," and in U.S. Pat. No. 5,727,254 to Dicker for "Restive Exercise Pants and Hand Stirrups."

An 1880 invention dedicated to protecting pant bottoms from excessive wear due to contact with the ground is shown by U.S. Pat. No. 229,031 to Campbell for a "Pantaloons Protector." The Campbell device consisted of a wire or thin piece of metal being formed into a double safety-pin arrangement for attachment of a portion therein to the back bottom of the slacks, with a pair of bends being below the hem to prevent any portion of the pant bottom from coming into contact with the ground.

Another approach for pant bottom protection was disclosed by U.S. Pat. No. 668,051 to Puffer for a "Trouser Protector." The Puffer trouser protector consisted of a single piece of flexible sheet metal formed into a series of curves, where one end is relatively straight for being inserted into, and retained by, a user's shoe, and having contact therein with the back of the user's foot. The other end had an upward loop that was used for clamping onto the bottom of the trousers.

U.S. Pat. No. 927,017 to Young disclosed a "Boot and Shoe" in which an upward facing tongue was incorporated into the rearward portion of the footwear at a position above the heel. The tongue would similarly serve to trap the slacks against the back part of the shoe to prevent slack bottoms from contacting the ground.

A more recent, but similar device was disclosed in 2003 in U.S. Pat. No. 6,618,862 to Bunjes for a "Pants Hem Guard." The Bunjes invention comprises a U-shaped inner portion for insertion into the back of a shoe, and also has a U-shaped outer portion with a clip insert attached thereto at its center, and at a height adjacent to the heel of the shoe. The pants hem would be tucked into the clip insert.

A slightly different approach is shown by U.S. Pat. No. 5,894,043 to Sood for a "Hem Holding Device." The Sood device is for temporarily raising the hem of the slacks, and essentially comprises an alligator clip that includes a piercing pin, to retain the excess pant bottom between the clip arms, with the pin piercing the cloth and also maintaining separation between the arms of the clip.

A different approach is shown by U.S. Pat. No. 7,404,215 to Allen for a "Detachable Protective Cuff Guard for Pants." The cuff guard comprises a durable material that incorporates magnetic fasteners along one edge, and corresponding magnetic fasteners along a respective opposite edge. The cuff guard is folded approximately midway between the two opposing edges, and about the bottom portion of the back side of the pants. The magnetic fasteners along the respective edges then serve to releasably secure the cuff protector to the slack bottoms to thereby protect the slacks from wear.

The invention disclosed herein serves the same function but eliminates the addition of parts and unsightly appearance to the slacks. The invention creates a process to tailor the bottoms of slacks according to a mathematical definition, to create a library of pre-designed, but nonetheless, modifiable pant bottom contours that follow specified edge trims.

OBJECTS OF THE INVENTION

It is an object of the invention to provide a method of manufacturing slacks such that the slack bottoms do not experience premature wear relative to the rest of the slack material.

It is another object of the invention to provide a method of manufacturing slacks that avoids excessive contact with the ground.

It is a further object of the invention to provide a pair of slacks or pants which are provided with cutout portions to permit the shoes of the wearer to be more clearly viewed.

It is a further object of the invention to provide a method of contouring slacks to repeatably provide a means of providing clearance of the slacks with the front portion of a wearer's shoes and the ground at the back of the wearer's shoes.

It is another object of the invention to provide a mathematical description for the selective contouring of a pant hem to avert excessive contact wear.

It is also an object of the invention to provide a means of communicating a three-dimensional definition for complex contouring of a pant bottom for input to a computer to control formation of the pant leg fabric to be pre-cut with the contour plus excess for the hem.

It is another object of the invention to provide a mathematical description for the selective contouring of a pant hem to accommodate variation in shoe heel heights and styles.

Further objects and advantages of the invention will become apparent from the following description and claims, and from the accompanying drawings.

SUMMARY OF THE INVENTION

A method for creating a series of size-proportioned trouser bottoms comprises each of the slack bottoms being approximated as a three-dimensional surface. A straight leg slack, or the straight leg portion of a slack having a flared bottom, may be modeled as a cylindrical surface. Where the slack bottom is flared, the slack may be modeled to be a cylindrical surface that transitions into a circular conical surface. The back lower portion of the circular conical surface may be trimmed along a cutting plane to produce a parabolic-shaped rear edge contour, to provide rear clearance above a shoe heel. The front lower portion of the circular conical surface may be trimmed along a second cutting plane producing a unique parabolic-shaped front edge contour for clearance above a shoe throat. The front and rear portions may be trimmed, other than according to a planar definition, to be trimmed according to a cylindrical definition, or by any other profile that is reducible to mathematical surface definition. The slack surface being so defined may be unwrapped and supplied to the CNC machine as a flat pattern. Trimming of the fabric may be by the CNC fabric cutting machine.

DETAILED DESCRIPTION OF THE INVENTION

Slacks may have bottoms that are modeled with a mathematical definition, and be illustrated using descriptive geometry with perspective representations of that mathematical definition. The mathematical definition may be adjustable for various sized persons, various shoe styles, and more particularly for variations in clearance to the shoe heel or throat, so that the slacks do not drag along the ground. The definition may also be adjusted for clearance with the shoe throat to prevent excessive sag therein.

Figure 1:
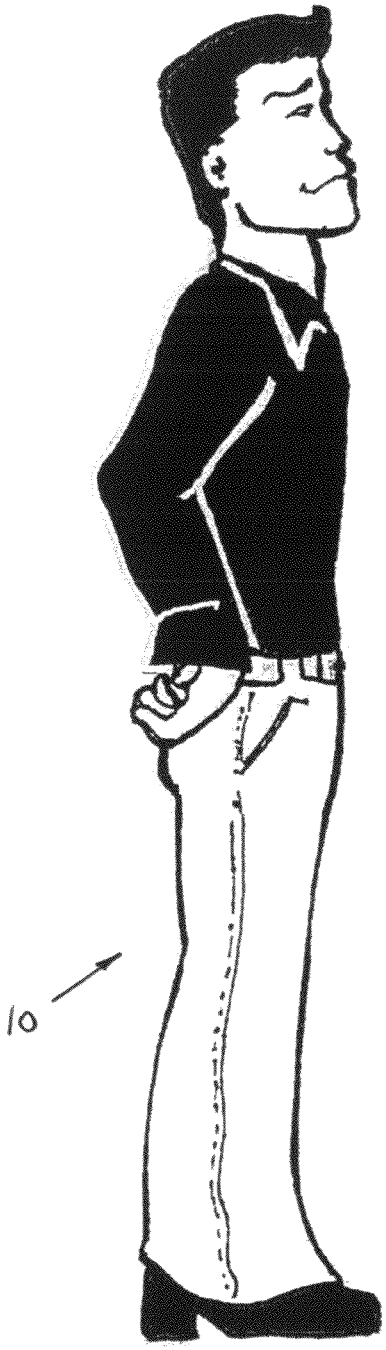
FIG. 1 is a side view of one series of slack bottoms formed using a first embodiment of the current invention.
Figure 2:
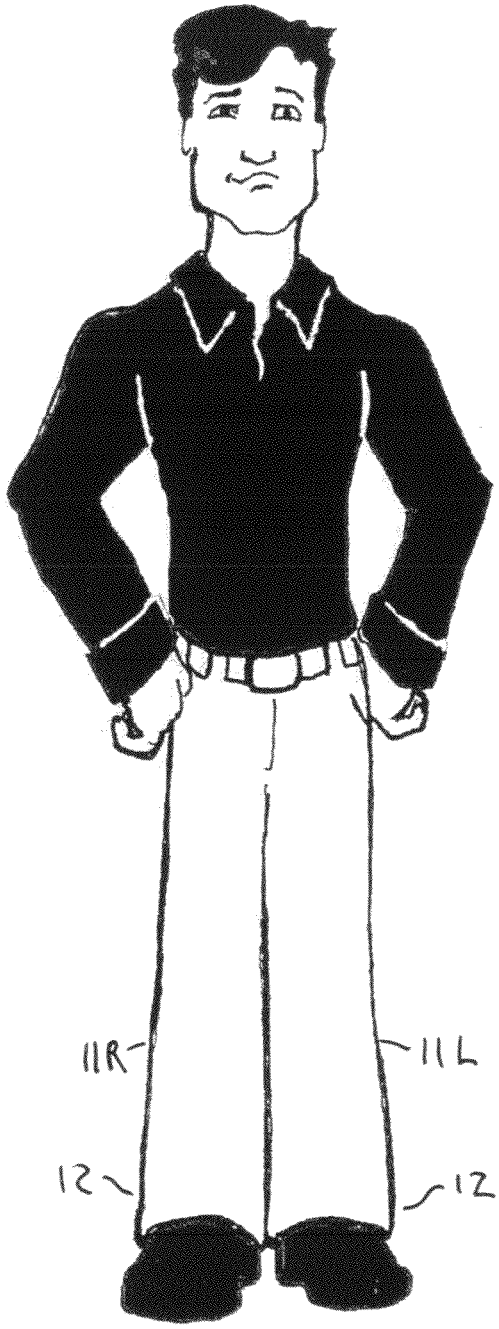
FIG. 2 is a front view of the FIG. 1 slack bottoms.
Figure 4:
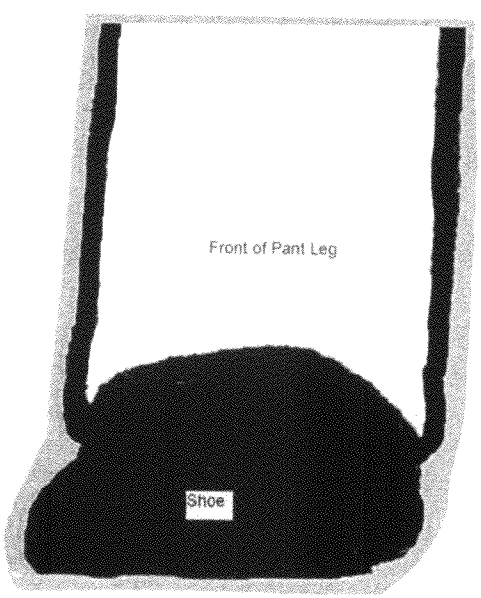
FIG. 4 is an enlarged front view of the slack bottoms FIG. 1.
Figure 3:
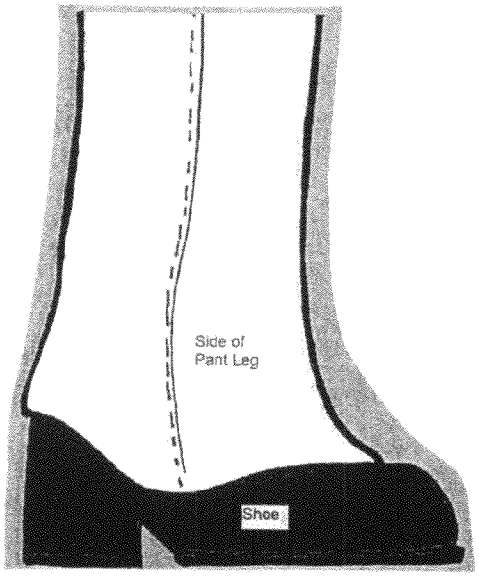
FIG. 3 is an enlarged side view of the slack bottoms of FIG. 1.
Figure 5:
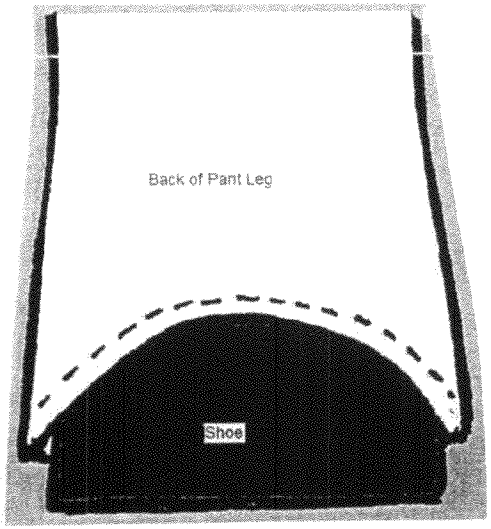
FIG. 5 is an enlarged rear view of the slack bottoms of FIG. 1.

FIGS. 1 and 2 show front and side views of an article of manufacture, being slacks 10, and having legs (11L and 11R) with bottoms 12 that were surface-modeled, cut, and assembled according to a method of the current invention. As seen in the enlarged side view (FIG. 3), front view (FIG. 4), and rear view (FIG. 5), the slacks may have custom contouring, which may be defined using mathematical definitions, with those mathematical definitions being communicable to a computer numerically controlled (CNC) fabric cutting machine. Examples of such CNC fabric cutting machines are currently produced by Autometrix Precision Cutting Systems, Inc., and by the Eastman Machine Company.

Figure 9:
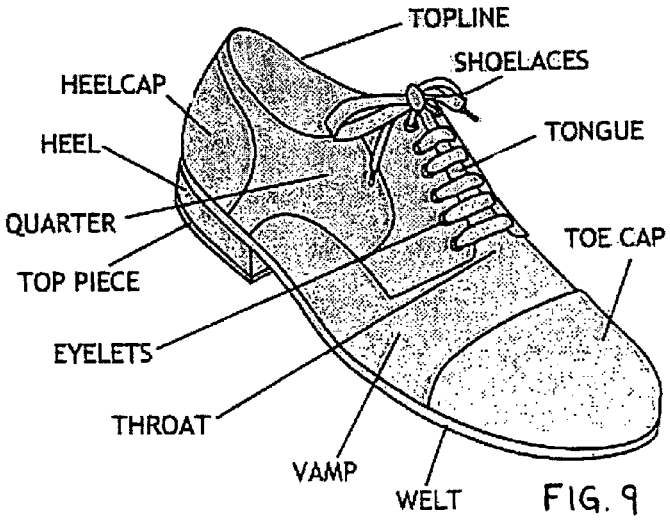
FIG. 9 is a perspective view of a representative shoe, with the names of the parts of the shoe illustrated thereon.

The slack bottom 12 may be surface modeled in a simple form as a cylindrical surface, but may be more accurately represented as a cylindrical surface that transitions into either an elliptical conical surface or a circular conical surface, where the front and rear portions of the slack bottoms may be specially trimmed to prevent the rear slack bottom from dragging on the ground or sagging at the heel, and prevent excessive slack-to-shoe-throat sag. The shoe throat (see FIG. 9) is that part of the shoe between the toe and the top of the tongue.

Manufacturing according to the disclosed method permits creation of a library of slack bottoms that may be tailored to coordinate to persons of different sizes, persons having different shoe sizes, and for varying styles of shoes, such as flat heeled shoes versus boot heeled or high heeled shoes. The process works for both men's and women's slack bottoms, and for denim jeans, or other fabrics.

Figure 8:
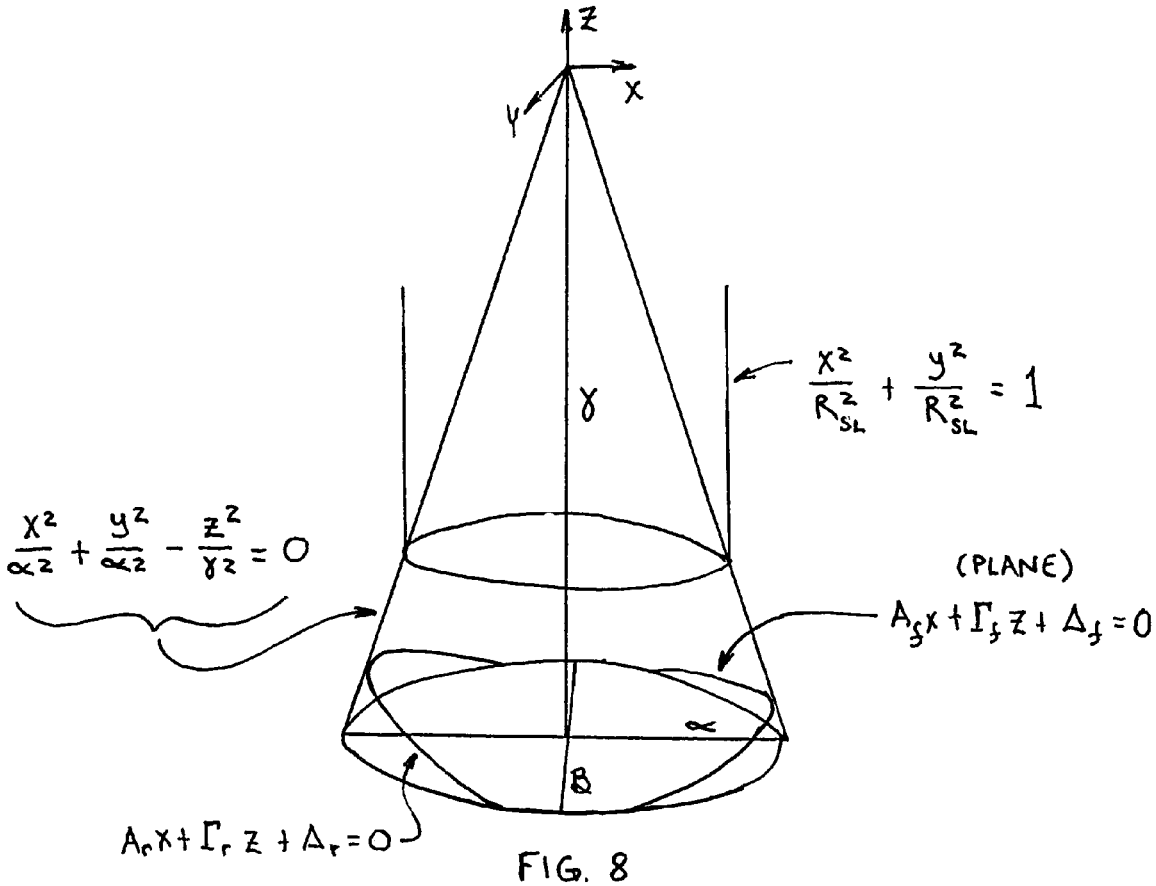
FIG. 8 is perspective view of wireframe descriptive geometry representing the slack bottom as a circular conical surface that transitions into a cylindrical surface, along with the associated mathematic definitions of those surfaces.

Surface modeling of a leg of the slack is shown in a simplified form in FIG. 8. The pant leg is surface modeled as a cylindrical surface, whose definition may be given by the equation:

$$(x)^2/R^2+(y)^2/R^2=1,$$

where "x" is a variable describing a coordinate position on the cylinder surface relative to the x-axis, "y" is a variable describing the coordinate position on the cylinder surface relative to the y-axis, and "R" is the radius of the cylinder. The z variable, which does not appear in the cylinder surface equation, will, in later equations, describe the coordinate position on a surface relative to the z-axis.

The slack may remain accurately represented by the cylindrical surface all the way until reaching the shoe, or, as is common with many garments, the slack may terminate in a flared bottom. It may also terminate in a reduced diameter cylindrical bottom. The case of the flared bottom may be more accurately represented by the cylindrical surface transitioning into an elliptical conical surface, or the circular conical surface shown at the bottom of FIG. 8.

The elliptical conical surface may be described by the equation:

$$(x/a)^2+(y/b)^2-(z/c)^2=0,$$

where x, y, and z are variables as previously described. To eliminate confusion herein, a, b, and c in the equation may be replaced by the Greek alphabetical equivalents of α, β, and γ, so the equation would appear as follows:

$$(x/\alpha)^2(y/\beta)^2-(z/\gamma)^2=0,$$

where α is the maximum x-coordinate value of the elliptical conical surface at the cone bottom, β is the maximum y-coordinate value of said elliptical conical surface, and γ is the maximum z-coordinate value of the elliptical conical surface.

The origin of the cone (coordinate being x=0, y=0, and z=0) may be conveniently chosen in relation to the maximum α, β, and γ values to produce a flare of desired proportions, and would commonly be at some point above the transition.

Since the slack is normally pressed to have creases and naturally thereafter tends towards an elliptical conical shape, the flared bottom of the surface model for the slack may be more simply represented by the special case of the elliptical cone, where β is equal to a to form a circular conical surface, which is described by the equation:

$$(x/\alpha)^2+(y/\alpha)^2-(z/\gamma)^2=0$$

Figure 7:
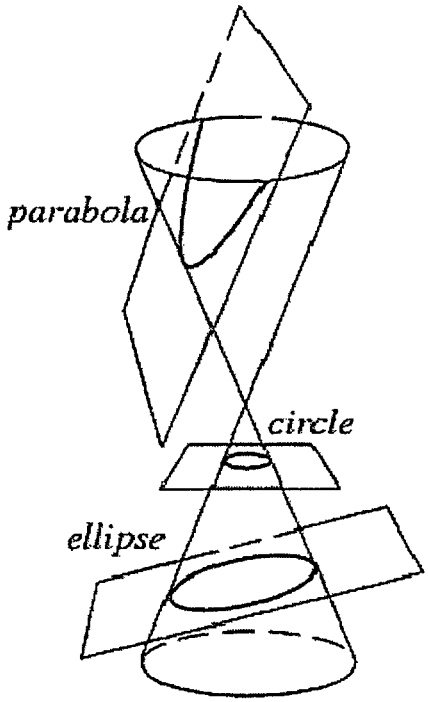
FIG. 7 is a perspective view of wireframe descriptive geometry illustrating a symmetrical pair of cones intersected by: a first plane being normal to the cone axis, with that intersection resulting in a circle; a second plane angled relative to the cone axis, with that intersection resulting in an ellipse; and a third plan angled relative to the cone axis and through the base of the cone, with that intersection resulting in a parabola.
Figure 6:
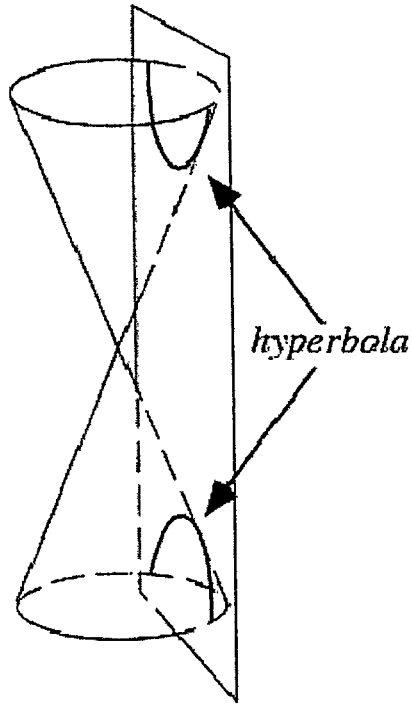
FIG. 6 is a perspective view of wireframe descriptive geometry illustrating a symmetrical pair of cones being intersected by a plane, with the intersection resulting in a pair of hyperbolas.

Trimming of the cylindrical surface or the circular conic surface of the slack bottom to achieve the aforementioned clearances may be accomplished using different cutting shapes. The simplest means of trimming the cylindrical surface or the circular conical surface may be to cut along a planar surface to create a forward and rear edge contour on the slack bottom. Planar intersections of a cone may form three different kinds of curves, which are illustrated in FIG. 7. The planar intersection where the plane is normal to the axis of the cone (the z-axis in FIG. 8) produces a circular entity. The planar intersection where the plane is angled with respect to the cone axis produces an ellipse, and where the angle is located to pass through the end of the cone at the maximum cone diameter, a parabola results.

The representation of the slack bottom in FIG. 8 may have the lower rear and forward portions of the circular conical surface trimmed with the planar cuts as shown, for the aforementioned clearance. The lower front portion of the slack may preferably be trimmed by a first carefully selected plane, while the rear portion of the slack may preferably be trimmed by another, different, plane. The front trim plane may be described by the equation:

$$A_f x+B_f y+\Gamma_f z+\Delta_f=0$$

Since the planar cut may likely be symmetric with respect to the x-z plane (see the profile view in FIG. 10), the plane equation reduces to:

$$A_f x+\Gamma_f z+\Delta_f=0,$$

where the equation's coefficients are denoted with the uppercase Greek characters of A, B, and Γ, rather than a, b, and c, and Δ is the perpendicular distance of the plane to the origin. The planar cut for the rear slack bottom portion may be similarly described by the equation:

$$A_r x+\Gamma_r z+\Delta_r=0,$$

Figure 10:
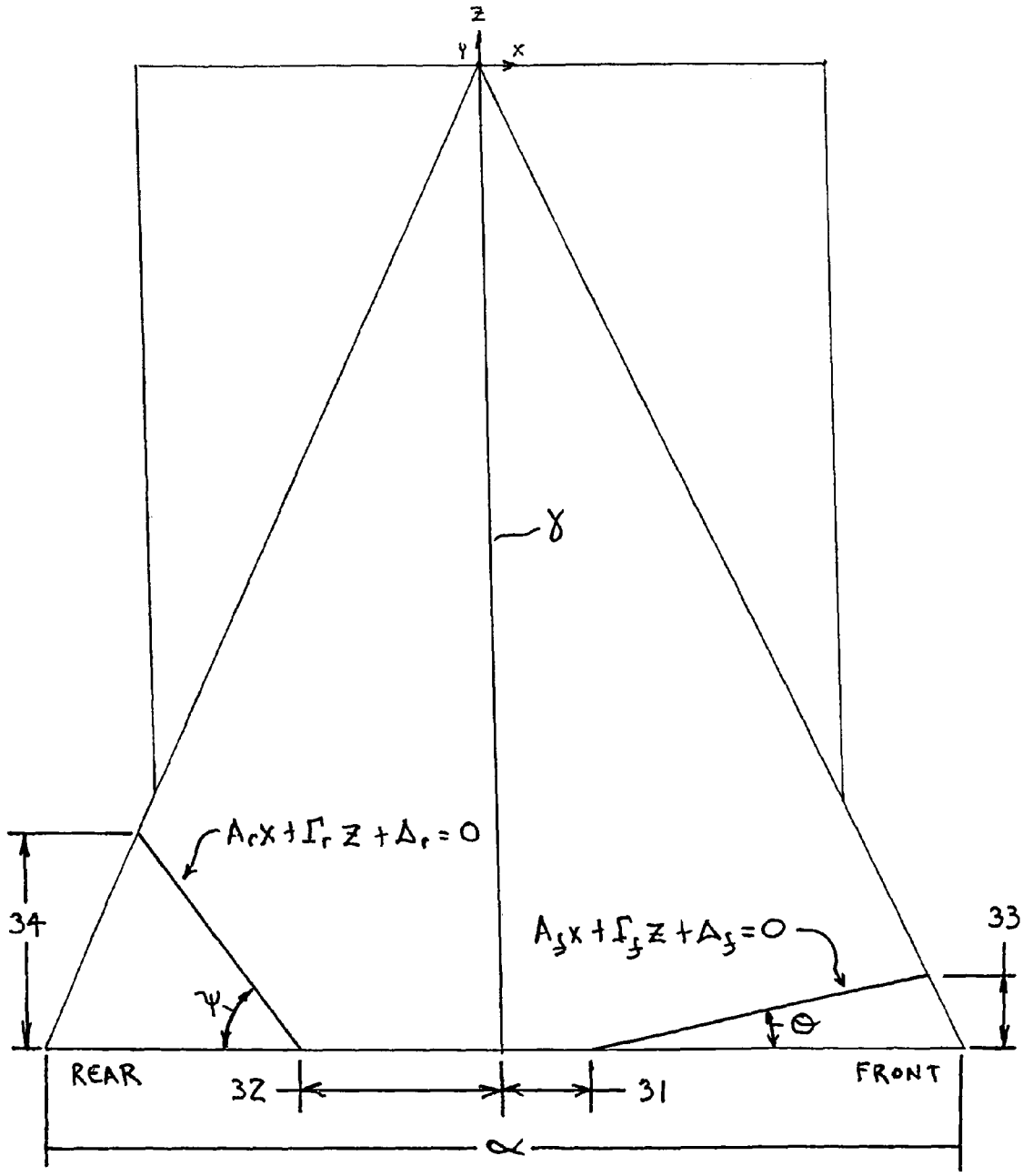
FIG. 10 is a side view of the descriptive geometry of FIG. 8, and illustrated thereon is a front planar cut to provide slack clearance with a shoe throat, and a rear planar cut to provide slack clearance with a shoe heel.

Trimming the circular conical surface according to those planar definitions may produce the forward and rear parabolic edge contours seen in FIG. 8, and which appear planar in the profile view of FIG. 10.

Figure 11:
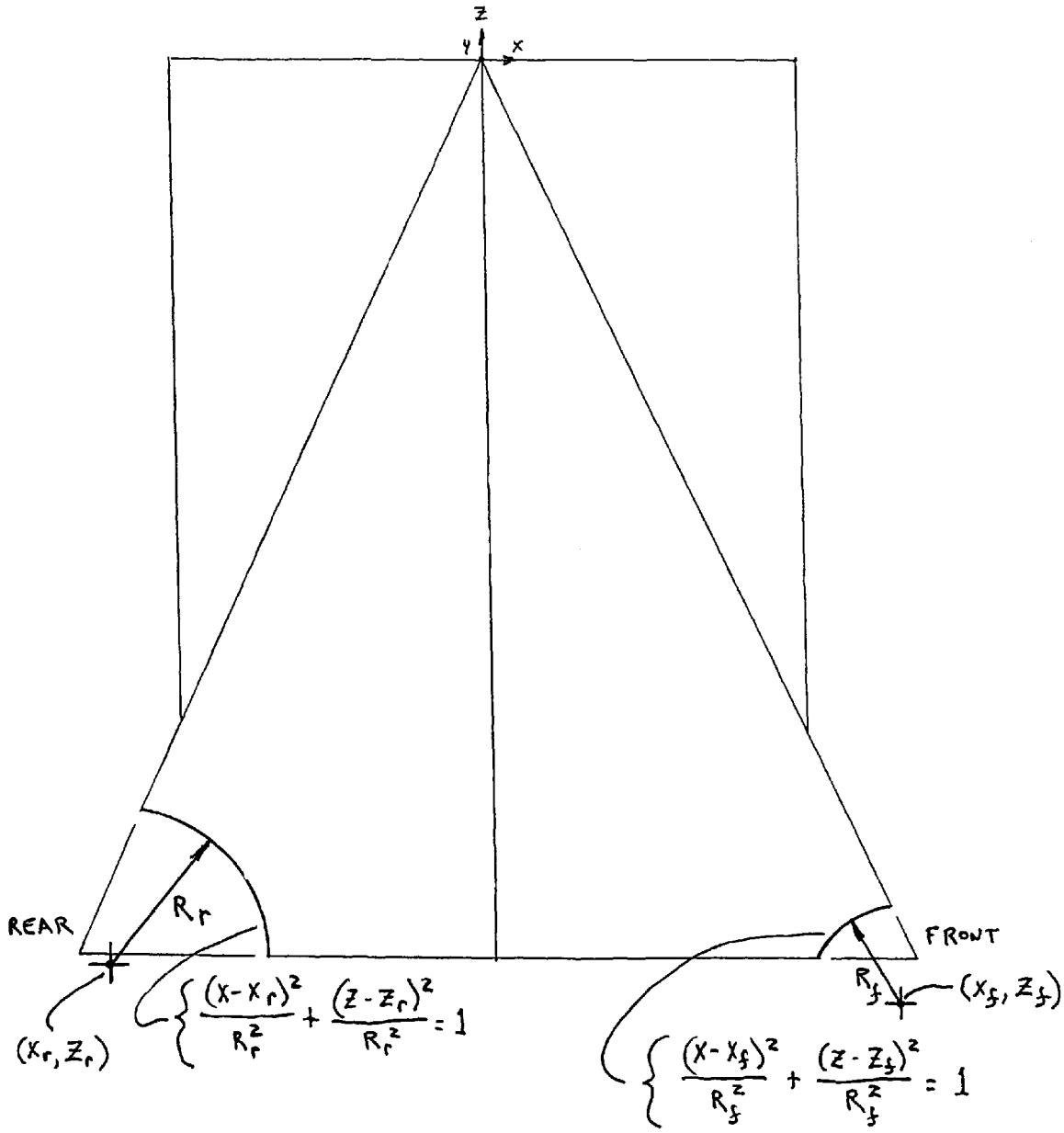
FIG. 11 is a side view of the descriptive geometry of FIG. 8, and illustrated thereon is a front cut defined by a cylindrical profile, to provide slack clearance with a shoe throat, and a rear cut defined by a cylindrical profile, to provide slack clearance with a shoe heel.

It should be pointed out that either of, or both of, the front and rear portions of the circular conical surface model of the slack bottom may be trimmed as just described. The bottom may also be trimmed according to other mathematical definitions. As seen in the profile view in FIG. 11, either of, or both of, the front and rear portions of the circular conical surface model of the slack bottom may be trimmed by a cylindrically defined cut, with respective equations of:

$$(x-x_r)^2/R_r^2+(z-z_r)^2/R_r^2=1$$

and $$(x-x_f)^2/R_f^2+(z-z_f)^2R_f^2=1,$$

where $x_r$ and $z_r$ comprise the coordinate location of the cylinder axis of a cylinder having a radius or $R_r$.

A surface, which may be a cylindrical surface or another surface having a discrete geometric definition, usable for cutting the circular conical surface (or cylindrical surface if so used to surface model pant legs) may be oriented so as to be positioned so as to be orientated non-orthogonal relative to the X/Y/Z axes, and therefore have an arbitrary axis. An example of where this may be desirably exploited through the current invention, is the case where surface modeling is used for a front cutting surface for the front slack bottom, where the front cutting surface represents the front portion of particular styles of shoes or boots, particularly for the likely shoe contact area—the throat. The mathematics involved becomes more substantial than those for profiling along an axis by a cylinder (FIGS. 11-12 and 13-15), but is discussed briefly in the following paragraph to enable such a trim contour, particularly as it may also be advantageously communicable to the CNC fabric cutting machine.

Figure 11A:
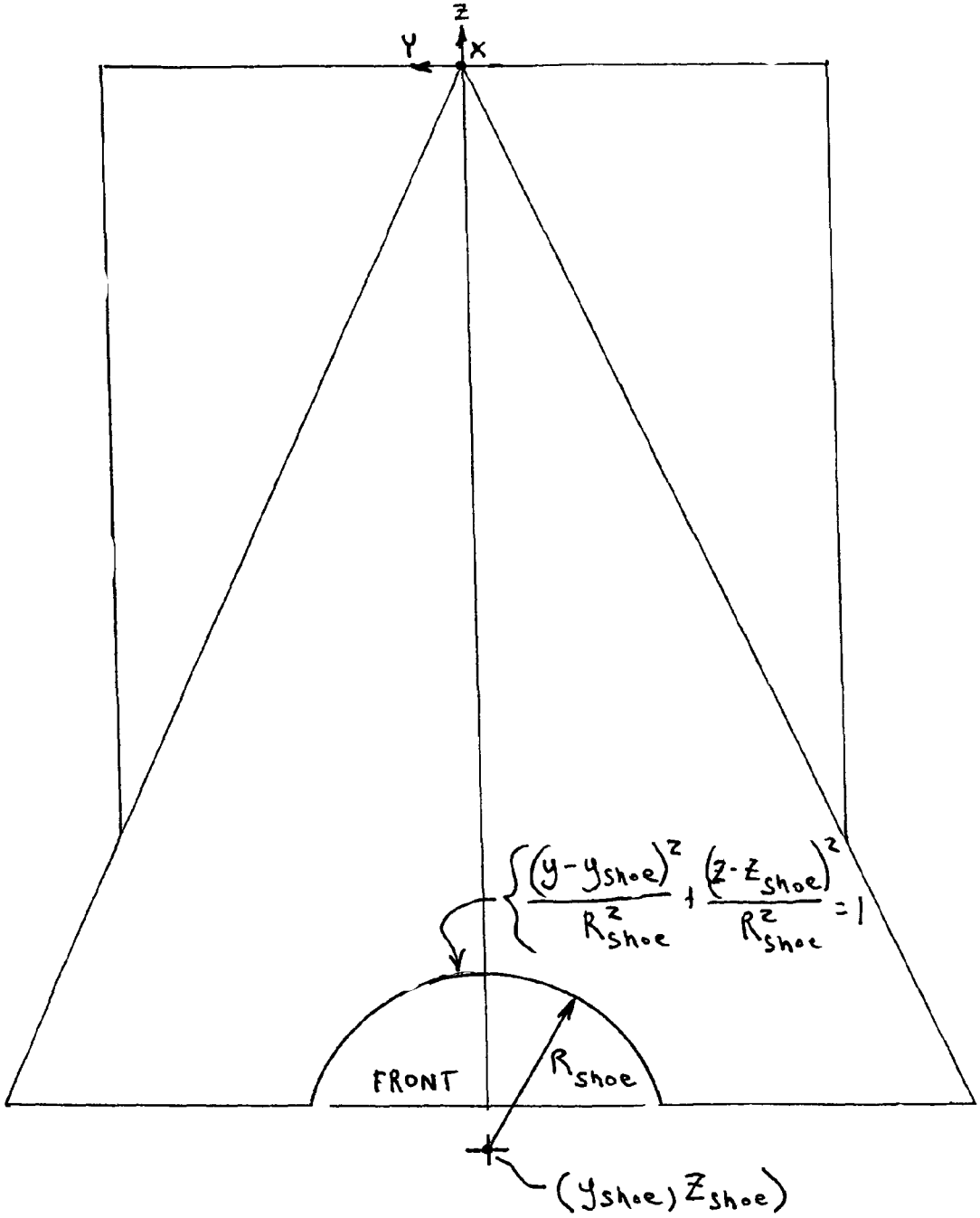
FIG. 11A front view of the descriptive geometry of FIG. 8, and illustrated thereon is a front cylindrical cut defined by a cylinder of radius $R_{shoe}$ and being parallel to the x-axis, to provide slack clearance with a shoe throat.
Figure 12:
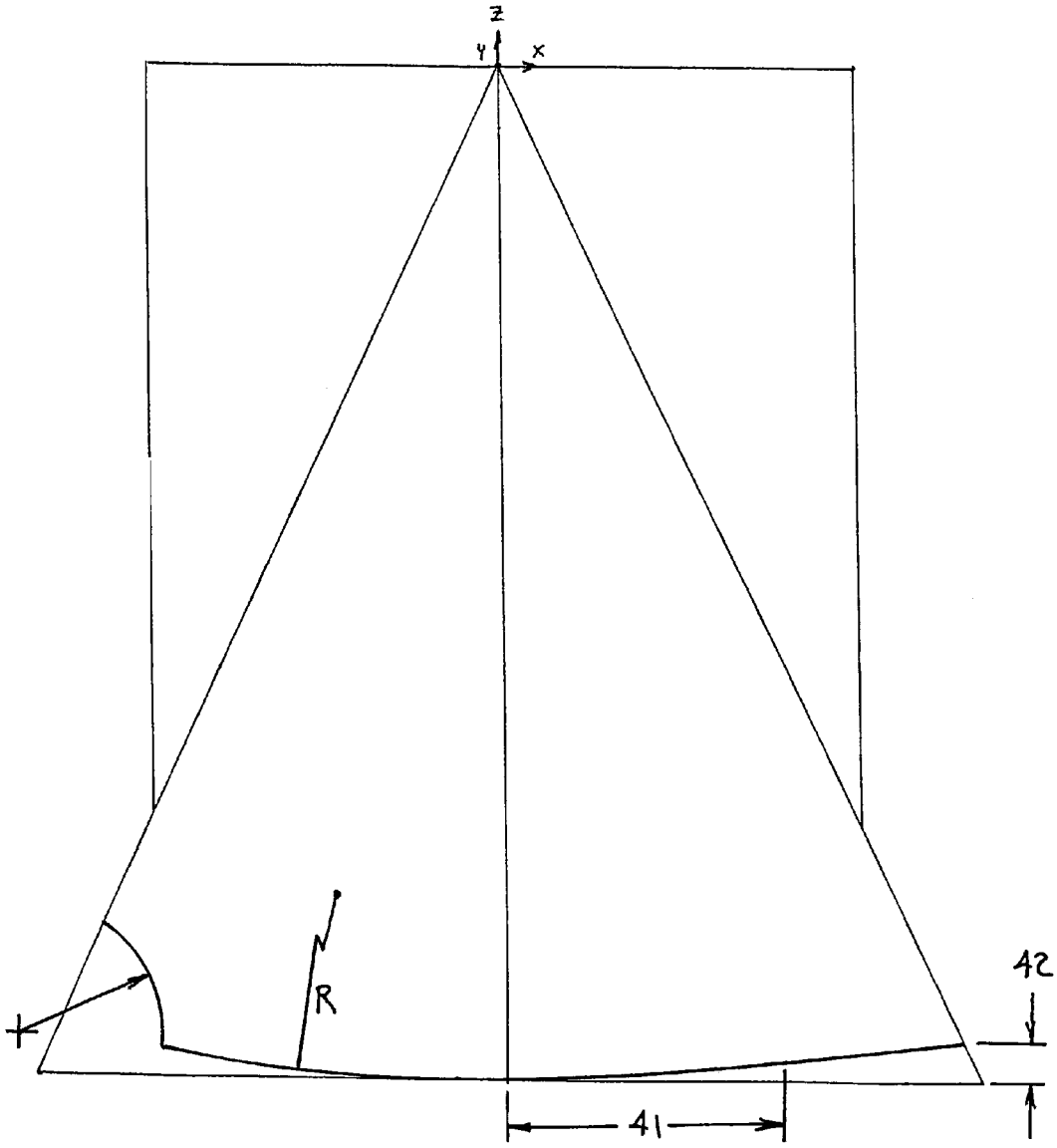
FIG. 12 is a side view of the descriptive geometry of FIG. 8, and illustrated thereon is a central cylindrical cut with radius R to provide a slack bottom that transitions into a front planar cut to provide clearance with a shoe throat, and transitions into a rear cut defined by a cylindrical profile to provide slack clearance with a shoe heel.
Figure 13C:
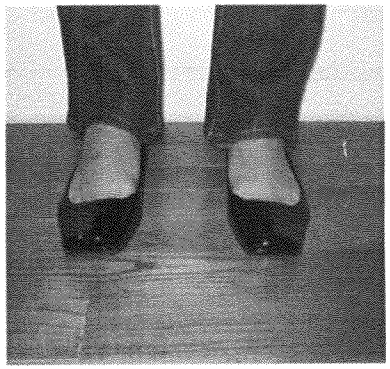
FIG. 13C is a front view of the article of FIG. 13A.
Figure 13B:
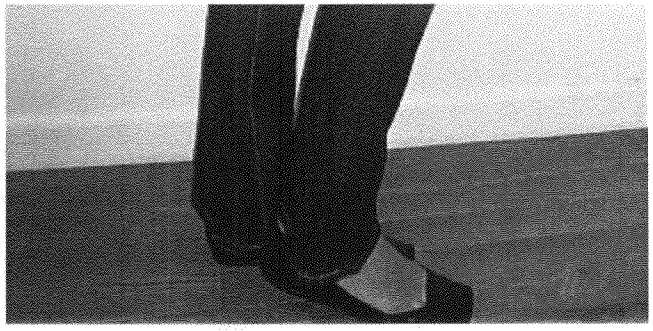
FIG. 13B is a right-side perspective view of the article of FIG. 13A.
Figure 13A:
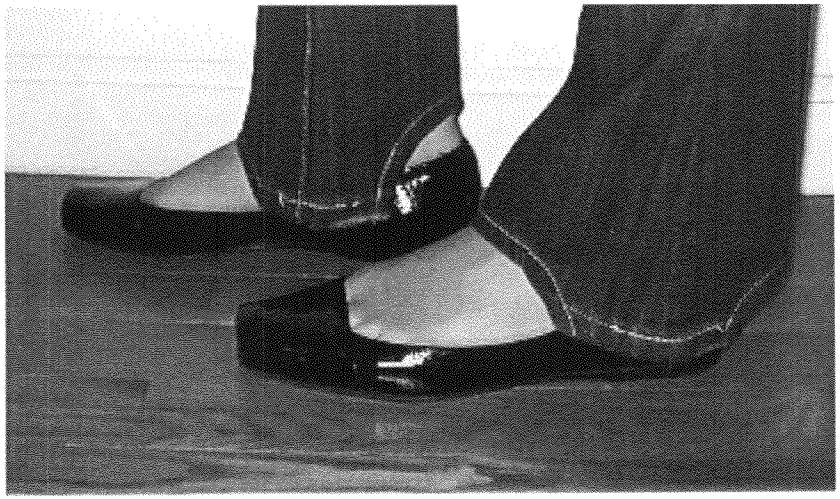
FIG. 13A is a left-side perspective view of a first article of manufacture produced according to the method of the current invention.
Figure 14B:
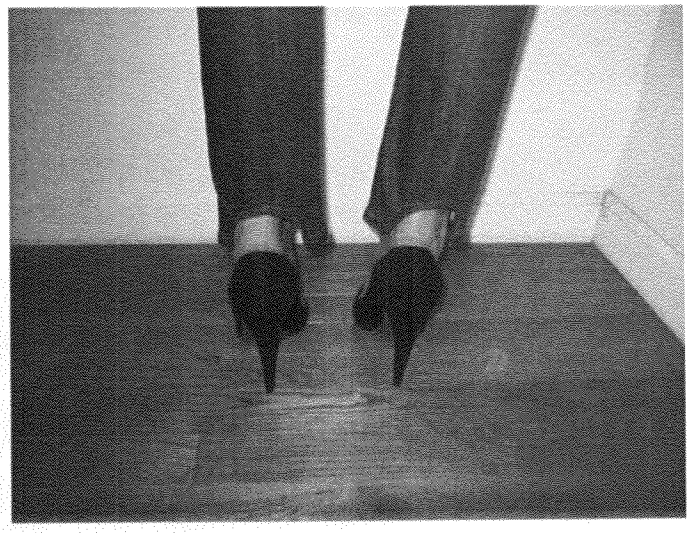
FIG. 14B is a rear view of the article of FIG. 14A.
Figure 14A:
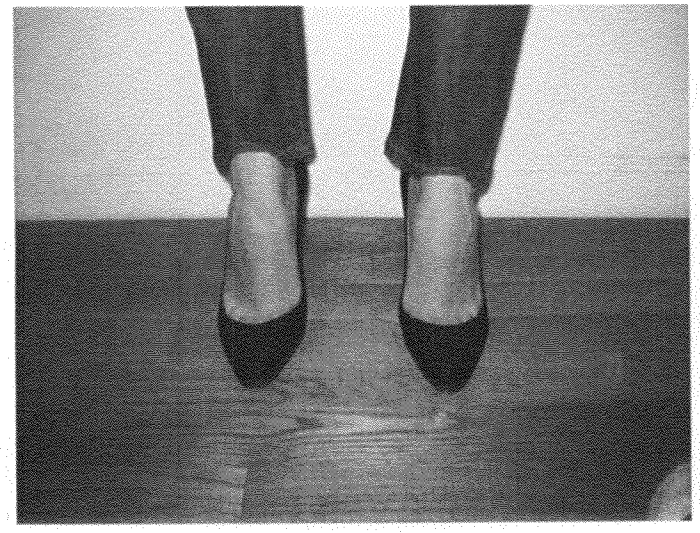
FIG. 14A is front view of a second article of manufacture produced according to the method of the current invention.
Figure 15C:
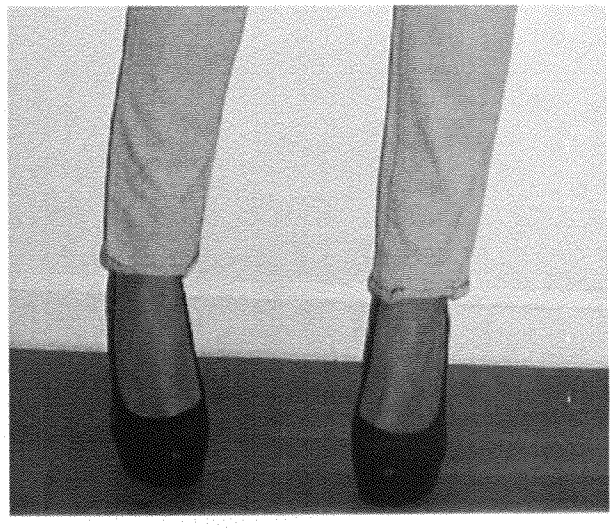
FIG. 15C is a front view of the article of FIG. 15A.
Figure 15A:
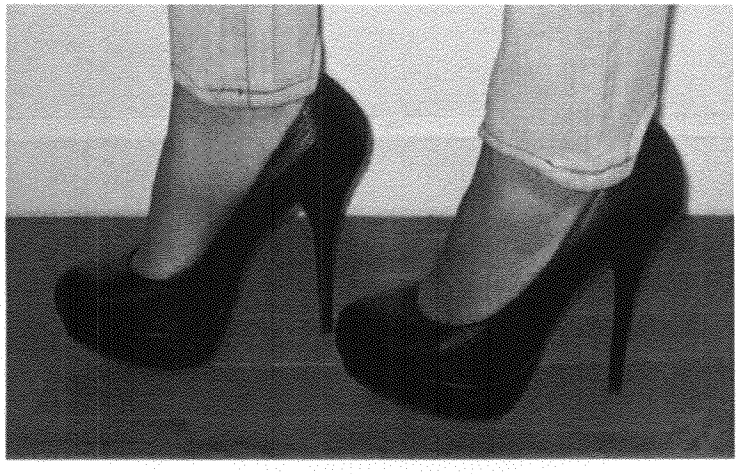
FIG. 15A is a left perspective view of a third article of manufacture produced according to the method of the current invention.
Figure 15B:
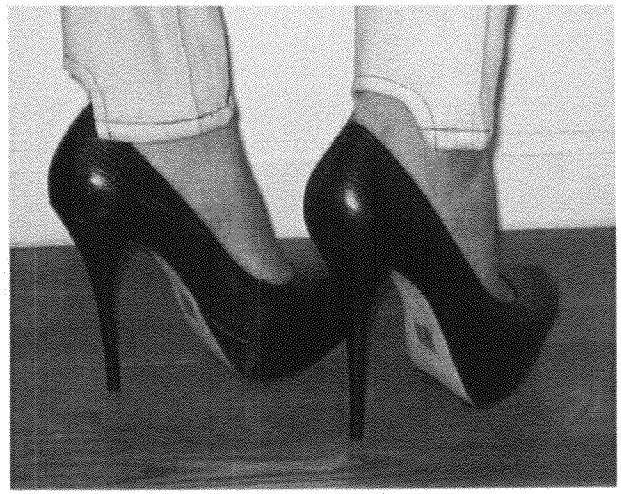
FIG. 15B is a rear perspective view of the article of FIG. 15A.
Figures 16A, 16B, 16C, 16D:
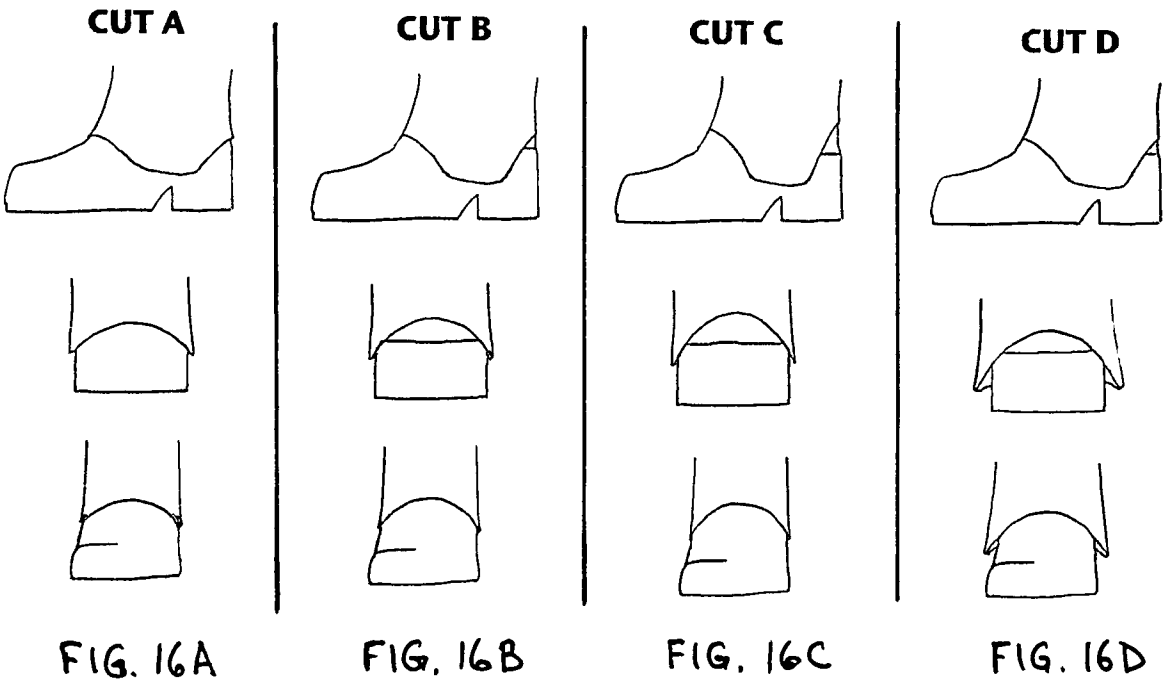
FIG. 16A is a stacked side, rear, and front view of a third article of manufacture produced according to the method of the current invention.
FIG. 16B is a stacked side, rear, and front view of a fourth article of manufacture produced according to the method of the current invention.
FIG. 16C is a stacked side, rear, and front view of a fifth article of manufacture produced according to the method of the current invention.
FIG. 16D is a stacked side, rear, and front view of a sixth article of manufacture produced according to the method of the current invention.
Figure 17:
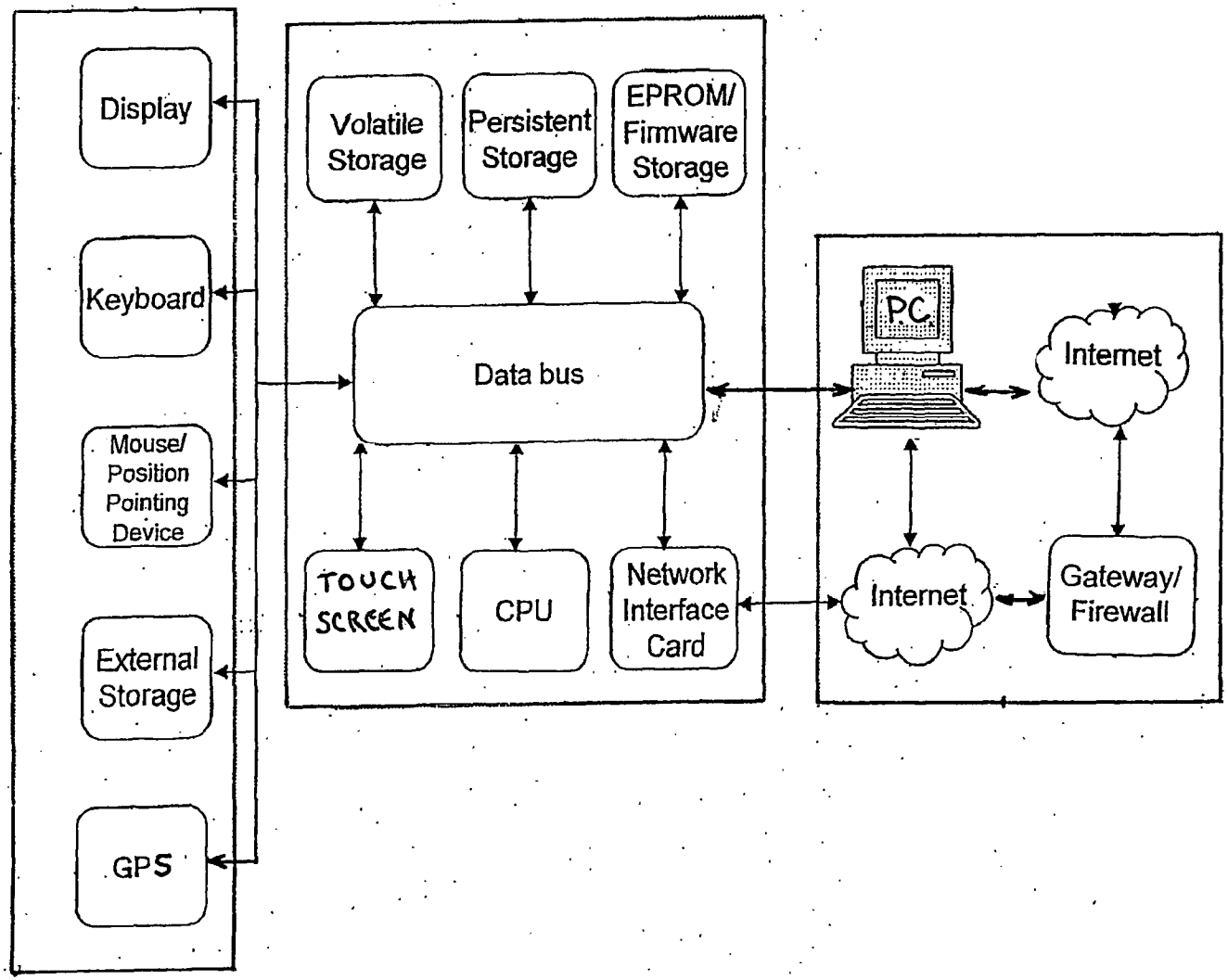
FIG. 17 is a schematic view of an exemplary computer system.

The front portion of a shoe, namely the tongue and throat area, may be approximated by a cylindrical surface. In FIG. 11A, a cutout is created by using a cylindrical surface having an axis parallel to the x-axis, where the x-axis is into the page. The cylinder may pass through the point ($y_{shoe}$, $Z_{shoe}$), having a radius $R_{shoe}$, and be defined by the equation:

$$(y-y_{shoe})^2/R^2_{shoe}+(z-z_{shoe})^2/R^2_{shoe}=1,$$

The cylindrical cut may better approximate the shape of the shoe's tongue and throat, by having an axis which is angled with respect to the x-axis. The mathematics involved for the angled cylinder may be described using a unit vector ($u_1$, $u_2$, $u_3$), or alternatively using parametric equations, the mathematics of which may be found in relevant math or geometry texts, papers or websites (e.g., http://mathforum.org/library/drmath/view/51734.html), which is incorporated herein by reference, as it may be beyond the scope of this presentation. It should also be noted that an irregular trim surface may also be defined mathematically and utilized for slack bottom contouring. Also, for simplicity, the front and back of the slack bottom may be trimmed so as to be identical.

The mathematical definition of the surface for the slack may be unwrapped into a flat pattern, permitting cutting of fabric according to that flat pattern on a CNC fabric cutting machine. The described slack surface definition may be generated using a processor of computer, which may then be unwrapped using the same computer, for transmission of that definition to the CNC machine. Use of the computer in relation to the trimming of the slack bottom requires description of an exemplary computer for enablement of the claims using such a processor.

An exemplary computing unit 201 may include a data bus 224 or other communication mechanism for communicating information across and among various parts of computing unit 201, and a central processing unit ("processor" or CPU) 222 coupled with a bus 224 for processing information and performing other computational and control tasks. Computing unit 201 may also include a volatile storage 225, such as a random access memory (RAM) or other dynamic storage device, coupled to bus 224 for storing various information as well as instructions to be executed by processor 222. The RAM may be Dynamic Random Access Memory (DRAM), or Static RAM (SRAM), or any other similar type of RAM known in the art. The volatile storage 225 also may be used for storing temporary variables or other intermediate information during execution of instructions by processor 222. Computing unit 201 may further include a read only memory (ROM) or an erasable programmable memory (EPROM) 227 or other static storage device coupled to bus 224 for storing static information and instructions for processor 222, such as basic input-output system (BIOS), as well as various system configuration parameters. A persistent storage device or non-volatile memory 226, such as a magnetic disk, optical disk, or solid-state flash memory device is provided and coupled to bus 224 for storing information and instructions.

Computing unit 201 may be coupled via bus 224 to a touch screen display 221, such as a plasma display, or a liquid crystal display (LCD), for displaying information to a user of the computing unit 201. If desired, the computing unit 201 may also be coupled via bus 224 to an external display screen 245, which may further comprise a cathode ray tube (CRT). An external input device 244, including alphanumeric and other keys, may also be coupled to bus 224 for communicating information and command selections to processor 222. Another type of user input device is cursor control device 243, such as a mouse, a trackball, or cursor direction keys for communicating direction information and command selections to processor 222 and for controlling cursor movement on display 245, if desired. Also, a cursor control device 243 may also be utilized for the PC 261 of the network resources 203.

An external storage device 242 may be connected to the computing unit 201 via bus 224 to provide an extra or removable storage capacity for the computing unit 201. In an embodiment of the computer system 200, the external removable storage device 242 may be used to facilitate exchange of data with other computer systems.

According to one embodiment of the invention, the techniques described herein are performed by computing unit 201 in response to processor 222 executing one or more sequences of one or more instructions contained in the volatile memory 225. Such instructions may be read into volatile memory 225 from another computer-readable medium, such as persistent storage device or non-volatile memory device 226. Execution of the sequences of instructions contained in the volatile memory 225 causes processor 222 to perform the process steps described herein. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 222 for execution. The computer-readable medium is just one example of a machine-readable medium, which may carry instructions for implementing any of the methods and/or techniques described herein. Such a medium may take many forms, including but not limited to, non-volatile media, volatile media, and transmission media. Non-volatile media includes, for example, optical or magnetic disks, such as storage device 226. Volatile media includes dynamic memory, such as volatile storage 225. Transmission media includes coaxial cables, copper wire and fiber optics, including the wires that comprise data bus 224. Transmission media can also take the form of acoustic or light waves, such as those generated during radio-wave and infra-red data communications.

Common forms of computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, an EPROM, a FLASH-EPROM, a flash drive, a memory card, any other memory chip or cartridge, a carrier wave as described hereinafter, or any other medium from which a computer can read.

Various forms of computer readable media may be involved in carrying one or more sequences of one or more instructions to processor 222 for execution. For example, the instructions may initially be carried on a magnetic disk from a remote computer. Alternatively, a remote computer can load the instructions into its dynamic memory and send the instructions over a telephone line using a modem. A modem local to computer system 200 can receive the data on the telephone line. The bus 222 may carry the data to the volatile storage 225, from which processor 222 retrieves and executes the instructions. The instructions received by the volatile memory 225 may optionally be stored on persistent storage device 226 either before or after execution by processor 222. The instructions may also be downloaded into the computing unit 201 via Internet using a variety of network data communication protocols well known in the art.

The computing unit 201 may also include a communication interface, such as network interface card 223 coupled to the data bus 222. Communication interface 223 provides a two-way data communication coupling to a network link that may be connected to a local network 262. For example, communication interface 223 may be an integrated services digital network (ISDN) card or a modem to provide a data communication connection to a corresponding type of telephone line. As another example, communication interface 223 may be a local area network interface card (LAN NIC) to provide a data communication connection to a compatible LAN. Wireless links, such as well-known 802.11a, 802.11b, 802.11g and Bluetooth may also used for network implementation. In any such implementation, communication interface 223 sends and receives electrical, electromagnetic or optical signals that carry digital data streams representing various types of information.

Network link 223 typically provides data communication to other network resources. For example, the network link may provide a connection through local network 262 to a host computer 261, or the computing unit 201 may connect directly to the host computer 261. Alternatively, the network link 223 may connect through gateway/firewall 263 to the wide-area or global network 264, such as an Internet. Thus, the computing unit 201 can access network resources located anywhere on the Internet 264. On the other hand, the computing unit 201 may also be accessed by others, with permission, who are located anywhere on the local area network 262 and/or the Internet 264. The other users may themselves be operating a platform similar to computer system 200.

Local network 262 and the Internet both use electrical, electromagnetic or optical signals that carry digital data streams. The signals through the various networks and the signals on network link and through communication interface 262, which carry the digital data to and from computing unit 201, are exemplary forms of carrier waves transporting the information.

Computing unit 201 can send messages and receive data, including program code, through the variety of network(s) including the Internet 264 and LAN 262, network link and communication interface 233. In the Internet example, when the computing unit 201 acts as a network server, it might transmit a requested code or data for an application program running on PC 261 through the Internet 264, gateway/firewall 263; local area network 262 and communication interface 223. Similarly, it may receive code from other network resources.

The received code may be executed by processor 222 as it is received, and/or stored in persistent or volatile storage devices 226 and 225, respectively, or other non-volatile storage for later execution. In this manner, computer system 200 may obtain application code in the form of a carrier wave.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

I claim:

1. An article of manufacture comprising slacks made of fabric with bottoms that prevent dragging and premature wear and permit more complete viewing of a wearer's shoes, said slacks having left and right slack bottoms which are provided with a contour to provide a rear clearance above a shoe heel a and front clearance above a shoe throat, each of said left and right slack bottoms comprising a leg formed in the shape of a cylindrical surface that transitions into a circular conical surface at a point above said slack bottom; at least a rear portion of said slack bottom having a cutout in said circular conical surface to produce a rear edge contour, said rear edge contour providing said rear clearance above said shoe heel; and at least a front portion of said slack bottom having a cutout in said circular conical surface to produce a front edge contour, said front edge contour providing said front clearance to accommodate a shoe throat, and wherein said circular conical surface representing said slack bottom comprises a circular conical surface defined by the equation:

$$(x/\alpha)^2+(y/\alpha)^2-(z/\gamma)^2=0,$$

where x is a variable describing a coordinate position on said surface by representing a distance along the x-axis, y is a variable describing said coordinate position on said surface by representing a distance along the y-axis, z is a variable describing said coordinate position on said surface by representing a distance along the z-axis, a is the maximum x-coordinate value of said circular conical surface and the maximum y-coordinate value of said circular conical surface, and y is the maximum z-coordinate value of said circular conical surface.

2. The article of manufacture according to claim 1, wherein said at least a rear portion of said circular conical surface terminates at a rear cutting plane to produce said rear edge contour, said rear edge contour comprising a parabolic shape; and wherein said rear cutting plane is defined by the equation:

$$\Delta_r x+\Gamma_r z+\Delta_r=0,$$

where $\Delta_r$ is the perpendicular distance from said rear cutting plane to the origin of said x, y, and z axes.

3. The article of manufacture according to claim 1, wherein said at least a front portion of said circular conical surface terminates at a front cutting plane to produce said front edge contour, said front edge contour comprising a parabolic shape; and wherein said front cutting plane is defined by the equation:

$$A_f x+\Gamma_f z+\Delta_f=0,$$

where $\Delta_f$ is the perpendicular distance from the forward cutting plane to said origin.

4. The article of manufacture according to claim 1, wherein said at least a rear portion of said circular conical surface terminates along a cylindrical profile, wherein said cylindrical profile is defined by the equation:

$$(x-x_r)^2/R_r^2+(z-z_r)^2/R_r^2=1,$$

where $x_r$ and $z_r$ comprise the coordinate location of the cylinder axis of a cylinder having a radius or $R_r$.

5. The article of manufacture according to claim 1, wherein said at least a front portion of said circular conical surface terminates along a cylindrical profile, wherein said cylindrical profile is defined by the equation:

$$(x-x_f)^2/R_f^2+(z-z_f)^2/R_f^2=1,$$

where $x_f$ and $z_f$ comprise the coordinate location of the cylinder axis of a cylinder having a radius or $R_f$.

6. The article of manufacture according to claim 1, wherein a portion of said slack bottom between said at least a front portion and said at least a rear portion terminates normal to said axis of said circular conical surface to produce a flat profiled edge; and wherein said slack surface definition is modeled using one or more processors of a computer system, said surface definition being transferred to a CNC fabric cutting machine, said CNC fabric cutting machine being used to trim said material of said slack according to said edge-contoured circular conical slack surface.

7. The article of manufacture according to claim 6, wherein said slack material is trimmed on said CNC fabric cutting machine by unwrapping said edge-contoured circular conical surface representing said trimmed slack bottom into a flat pattern, whereby said definition of flat pattern is communicated to said CNC fabric cutting machine.

8. The article of manufacture according to claim 7, wherein said equation defining said circular conical surface is utilized to create a series of size-proportioned slacks.

9. An article of manufacture comprising slacks made of fabric with bottoms that prevent sagging of said slacks upon various shoe styles and permit more complete viewing of a wearer's shoes, said slacks comprising left and right slack bottoms having a contoured edge to provide a front clearance above a shoe throat, each of said left and right slack bottoms comprising a leg formed into a cylindrical shape; at least a front portion of each of said slack bottoms having said cylindrical shape terminating to produce a front edge contour, said front edge contour providing said front clearance above said shoe throat, and wherein said cylindrical surface of said slack leg is defined by the equation:

$$(x)^2/R^2_{sl}+(y)^2/R^2_{sl}=1$$

where x is a variable describing a coordinate position on said surface by representing a distance along the x-axis and being relative to the axis of said slack cylinder, said axis of said slack cylinder being the z-axis; y is a variable describing said coordinate position on said surface by representing a distance along the y-axis and being relative to said z-axis; and $R_{sl}$ is the radius of said cylindrical surface.

10. The article of manufacture according to claim 9, wherein said front edge contour of said slack cylinder is formed by terminating said slack cylindrical surface at a second cylindrical surface, said second cylindrical surface having an axis orthogonal to said slack axis, said second cylindrical surface being defined by the equation:

$$(y-y_{shoe})^2/R^2_{shoe}+(z-z_{shoe})^2/R^2_{shoe}=1$$

where $y_{shoe}$ and $z_{shoe}$ are a coordinate position for the center of said second cylindrical surface, and $R_{shoe}$ is the radius of said second cylindrical surface.

11. The article of manufacture according to claim 9, wherein said front edge contour is formed by a cylindrical surface having an axis that is angled relative to said axis of said slack cylinder.

* * * * *